United States Patent [19]

Mohanty

[11] Patent Number: 4,690,058

[45] Date of Patent: Sep. 1, 1987

[54] SMOOTH WALL BLASTING IN ROCK

[75] Inventor: Bibhuti B. Mohanty, Otterburn Park, Canada

[73] Assignee: C-I-L Inc., North York, Canada

[21] Appl. No.: 20,119

[22] Filed: Feb. 27, 1987

[30] Foreign Application Priority Data

Apr. 9, 1986 [CA] Canada ..... 506242

[51] Int. Cl.[4] ..... F42D 3/00

[52] U.S. Cl. ..... 102/312; 102/313; 299/13; 175/4.51

[58] Field of Search ..... 102/312, 313; 299/13; 175/4.51, 4.55; 166/63

[56] References Cited

U.S. PATENT DOCUMENTS

| | | | |
|---|---|---|---|
| 3,582,138 | 6/1971 | Loofbourow | 299/13 |
| 3,877,373 | 4/1975 | Bergmann et al. | 299/13 X |
| 3,902,422 | 9/1975 | Coursen | 102/312 X |
| 4,040,329 | 8/1977 | Ljungberg | 102/313 X |
| 4,290,649 | 9/1981 | Ricketts | 299/13 X |
| 4,326,752 | 4/1982 | Ricketts | 299/13 X |
| 4,333,684 | 6/1982 | Ricketts et al. | 102/312 X |
| 4,434,654 | 3/1984 | Hulsing, II et al. | 175/45 X |
| 4,550,786 | 11/1985 | Rosenstock | 102/312 X |

FOREIGN PATENT DOCUMENTS

| | | | |
|---|---|---|---|
| 687234 | 3/1975 | U.S.S.R. | 299/13 |

OTHER PUBLICATIONS

Mining Engineering, *Novel Void-Hole Process May Improve in Situ Fragmentation,* Mar., 1979, p. 269.

*Primary Examiner*—Peter A. Nelson

[57] ABSTRACT

A method of smooth wall rock blasting is provided in which an alignment of boreholes for explosive charging is drilled into rock and a single, smaller diameter empty borehole is drilled close and parallel to, and on each side of each charged borehole. Upon detonation of the charged boreholes, the rock is cracked smoothly along the plane coincident with the axes of the holes. The method reduces drilling costs to a minimum and provides improved results over the previous pre-shearing and other known methods.

6 Claims, 4 Drawing Figures

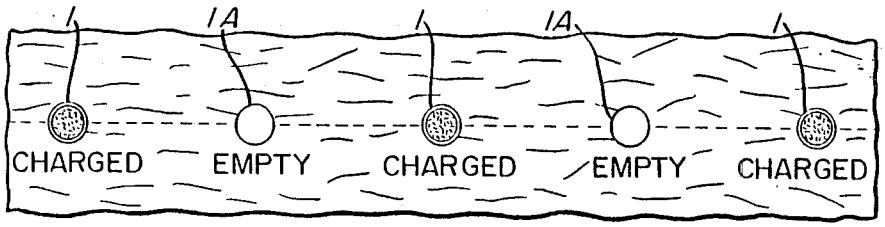
PRIOR ART PRE-SHEARING METHOD
FIG. 1A
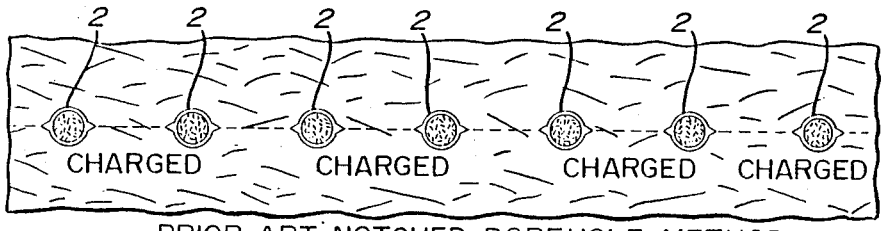
PRIOR ART NOTCHED BOREHOLE METHOD
FIG. 1B
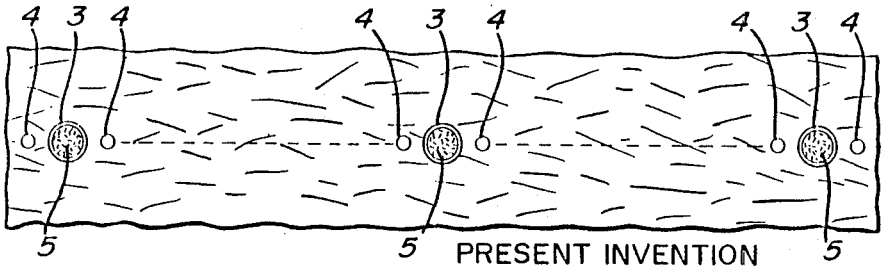
PRESENT INVENTION
FIG. 2
FIG. 3
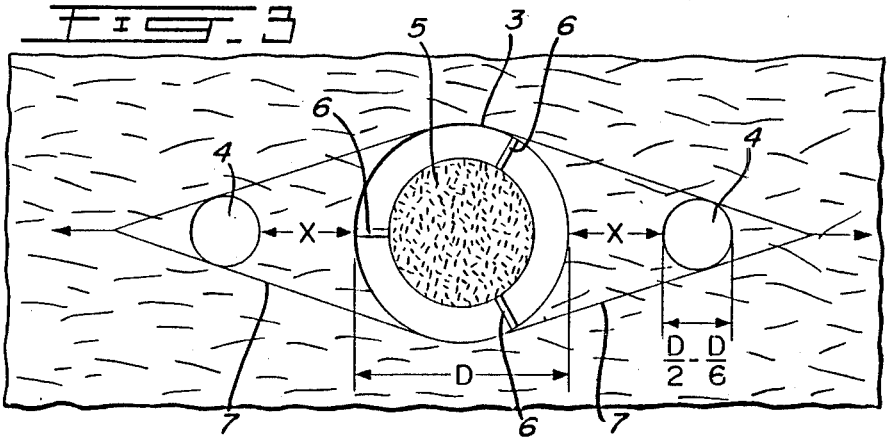

SMOOTH WALL BLASTING IN ROCK

BACKGROUND OF THE INVENTION

1. Field of the Invention

The present invention relates to blasting with explosives. More particularly, a blasting method is provided whereby a clean, substantially smooth and flat vertical rock face can be achieved in the excavation of highway and railroad cuts, canals, quarries, mines, building sites and the like in rock.

In the excavation of rock from a work site, it is often important that the remaining wall of, for example, a cutting or quarry face be left as clean and smooth as possible. Such clean walls decrease the amount of loose material on the sides resulting in greater safety and a reduction in the labour required to clear any such loose material. In mining operations, a relatively smooth wall results in greater stability of pit and backwalls. This allows steeper slope angles, thereby reducing the overall cost of mining an ore body. Additionally, where excavation walls are to be faced with concrete, the presence of a smooth and regular wall face reduces the amount of concrete needed with consequent savings in both labour and materials.

2. Description of the Prior Art

Heretofore, smooth wall blasting has been undertaken by employing several different methods variously known as perimeter blasting, pre-shearing, pre-splitting, contour blasting, cushion blasting and buffer blasting.

In one method, very small diameter holes have been drilled vertically into the rock in close spacing. These holes are, then, charged with explosives which, upon detonation, produce a clean crack or shear in the rock extending between each hole and reaching from the mouth to the base of each hole. Subsequent excavation of the rock leaves a smooth, flat wall. This method is costly since a very large number of small diameter holes must be drilled and expensive, sensitive, small diameter explosive cartridges are required.

A second method employing the same principle requires the drilling of aligned, medium diameter boreholes at spaced intervals in the rock for explosive charging. One or more intermediate unfilled boreholes are drilled between the charged boreholes. When the charged boreholes are detonated, the rock tends to be sheared along the entire line of boreholes. This method, commonly referred to as pre-shearing, requires the drilling of a substantially large number of boreholes in order to achieve a smooth wall result. In harder rock, holes may be required to be spaced every meter or less in order to produce the desired results.

Another technique of producing substantially reduced blast-induced damage to backwall involves reducing the amount of explosives in the last row of holes in a multiple row blast. These holes, sometimes drilled at an angle towards the pit floor, contain a full explosive load at the bottom but contain decked or smaller diameter, decoupled charges along the column. This last row of holes can be fired ahead or along with the main production blast. This technique is known as buffer blasting.

Of the above techniques, only pre-shearing employing small diameter holes and small spacings yields acceptable smooth wall results. The other techniques merely reduce the degree of overbreak along the backwall, compared to regular production blasts.

In a more recently developed technique, the boreholes may be reduced in number by means of notching whereby the inner walls of the boreholes are scored or notched at their circumference along the line of desired shear. Such borehole notching requires the use of special drilling equipment and techniques and has not proven to be particularly cost effective or successful.

SUMMARY OF THE INVENTION

The present invention provides an improved smooth wall blasting method which method comprises the drilling of a series of aligned nested or grouped triad boreholes along a plane, each triad group comprising a large central hole for decoupled explosive charging and one empty small, parallel, close-spaced satellite hole on each side of the large central hole, the said triad groups being separated along a desired crack extension in rock. A practical spacing between the central charge borehole and the empty satellite holes is about two times the diameter of the charged central borehole. However, this spacing may vary depending on the nature of the rock to be cracked and the type of explosive selected. A practical ratio between the diameter of the central borehole and the satellite hole is 4:1 with a lower ratio of 2:1. Higher ratios may be employed where the rock type permits. The spacing between the triad groups will vary depending on the rock type, the type of explosive used, the degree of decoupling between explosive and the borehole wall and diameter. The spacing generally ranges from about 10 central borehole diameters to 25 central borehole diameters.

BRIEF DESCRIPTION OF THE DRAWINGS

FIG. 1A shows an alignment of charged and empty boreholes employed in the prior art pre-shearing smooth wall blasting method;

FIG. 1B shows an alignment of charged boreholes employed in the prior art notched borehole blasting method;

FIG. 2 shows an alignment of the triad group blasting method of the present invention; and FIG. 3 shows an enlargement of a triad group of boreholes shown in FIG. 2.

DESCRIPTION OF THE PREFERRED EMBODIMENTS

In the prior art pre-shearing blasting method shown in FIG. 1A, a series of boreholes 1 and 1A are drilled downward and in alignment into the rock body which is desired to be cracked or sheared along the dashed line. The boreholes are customarily drilled vertically from 30 cm to 90 cm apart depending on the hardness and grain of the rock. Every second hole 1 is charged with explosives, normally from the toe to collar, while the intermediate boreholes 1A are left empty. The charged holes are detonated either simultaneously or in time-delay sequence. The resulting energy release cracks the rock substantially along the desired plane. While generally successful, the pre-shear method may require the drilling of closely-spaced boreholes and the use of relatively heavy explosive charges to achieve the desired smooth wall effect. Frequently, undesired crushing of the rock in the area of the detonated borehole results.

In the notched borehole blasting method shown in FIG. 1B, a series of boreholes 2 are drilled vertically downward in an alignment into the rock body which is desired to be cracked or sheared along the dashed line. After drilling, the boreholes are notched along their full length using a special notching tool or a high pressure hydraulic jet so that the notches or indentations are produced at adjacent points on the borehole circumference and in alignment with the dashed line. After charging with explosives, the boreholes are detonated and the rock is cracked along the desired plane—the notches acting as points of weakness. The notched borehole method tends to be costly in terms of the special equipment and labour required for the notching operation. In addition, the material dislodged in the notching operation falls to the bottom of the borehole and is removed with difficulty. Furthermore, explosive use may be greater than the pre-shear method. This technique is still in the experimental stage and most published documents describe only small-scale studies in plastic or other model materials.

In the method of the present invention as shown in FIGS. 2 and 3, a series of substantially widely spaced vertical boreholes 3, having a diameter D, are drilled downward and in alignment along the plane of the desired crack shown by the dashed line. On each side of borehole 3 and in line with the plane of the desired crack, separate small diameter satellite vertical boreholes 4, each having a diameter of from about D/2 to about D/6 are drilled downward to the same or nearly the same depth as borehole 3. The distance X between borehole 3 and each satellite borehole 4, as shown in FIG. 3, will vary with rock type but will generally be of the order of two times the diameter of borehole 3. Boreholes 3 are charged with explosives 5, which charge may be centred within the borehole by means of a spacer element 6. The explosive is decoupled from the borehole wall by the spacers, the degree of decoupling depending on the geometry of the triad and the type of explosive charge. The annulus between explosive 5 and the inner wall of borehole 3 may be filled with a coupling material, such as, water, to allow for more effective energy transfer to the rock. When the explosive 5 is detonated, the borehole 3 is pressurized by the explosion gases and generates a shock wave in the rock. The satellite holes 4 on either side of the charge hole act as stress concentrators. It can be shown analytically that the satellite holes 4 function as 'equivalent' notches on charge hole 3, and the triad of holes with charge hole 3 pressurized, behaves analogous to a notched hole depicted by the triangular configuration represented by lines 7. The high stress concentration factors associated with the satellite holes 4 induce cracking along a diametral plane on the perimeter of the latter but co-linear with the line joining the axes of the holes. These cracks continue to propagate until they meet the charge hole 3 boundary or another crack in the same plane issuing from the latter. The result is a vertical (for vertical triads) fracture plane extending from the charge hole 3 to the satellite holes 4 and beyond, which is subsequently wedged open and extended further by the permeating high pressure explosion gases originally contained in charge hole 3. Initially, the shock pressure tends to produce other radial cracks of varying lengths on the perimeter of the charge hole in addition to the co-linear crack along the direction of the satellite holes. However, these other cracks are of much smaller length than the co-linear crack. Since crack extension is restricted to the weakest plane, represented by the longest crack, all subsequent crack extension in blasts employing this technique is largely restricted to this co-linear crack plane. By design of a series of such triads of appropriate spacing, it is possible to generate a controlled and predictable fracture plane along a specified direction on the horizontal plane and at any specified angle around the vertical plane. This fracture plane represents the desired smooth wall in blasting operations. As will be understood by the skilled blaster, the amount and type of explosive 5 employed in borehole 3 will be carefully chosen so as to provide the necessary cracking energy without undue crushing of the rock adjacent the initiated borehole. Generally, this is best accomplished by employing a charge which is spaced in the centre of the borehole, as shown in FIG. 3. In its simplest form, the method of the invention will employ centrally charged boreholes with only air acting as the coupling medium between the explosive and the borehole wall. In other forms, water or fine gravel may be selected as a coupling medium. Similarly, the charged boreholes may be collar-stemmed or not depending on the type of rock to be cracked. In some cases, the borehole may be charged with sensitive flowable or pumpable explosives such as water gel-slurry explosives or water-in-oil emulsion explosives.

The explosive column may be initiated at the top of the charged hole 3 or at the bottom of hole 3, or may be side-initiated along the entire length of the explosive column. The continuous column of explosives can also be replaced by a series of explosive decks but all decks need to be initiated instantaneously or nearly simultaneously. It is not necessary that all boreholes in each triad be parallel throughout their length. Convergence or a certain amount of divergence of these holes on the same plane is allowed. However, any anti-plane deviation of these holes may render the final backwall nonplanar and its alignment less predictable. The effectiveness of the technique in producing cracks along specified and predictable directions has been clearly demonstrated in both laboratory and field studies.

EXAMPLE I

In the laboratory, Plexiglas* plates (6 mm thick) were used as two-dimensional analogs of actual 3-dimensional geometry characteristic of blasting. This is analogous to taking a horizontal slice of rock along the length of the borehole and duplicating the fracture propagation characteristics. In these model studies, the diameter of the central charge hole 3 was varied from 29 mm to 19 mm, the satellite hole 4 diameter from 9.5 mm to 4.8 mm, and spacing X between satellite and charge hole from 6 mm to 75 mm. Detonators (electric blasting caps) of different strengths (depending on the amount of explosive contained; maximum weight of explosive used was 0.9 g of PETN), served as the explosive charge placed in the charge hole with spacers. Both unconfined and partially confined conditions were investigated. The latter was achieved by sealing the central hole 3 containing the detonator by potter's clay placed on both faces of the Plexiglas plate models. Optimum combination of explosive weight, spacing and diameter ratio were determined to produce cracks co-linear with the axes of the triad of holes, and largely to the exclusion of cracks in any other direction. Even with the maximum weight of explosive, the crack generated along the direction of the axes was significantly longer than any other crack generated along the periphery of the central hole. It was also demonstrated that a pre-cracked central hole (produced by detonating a small amount of explosive, with no satellite holes present) when reblasted with suitable satellite hole and spacing generated the desired long crack along the axes despite the presence of numerous other pre-existing cracks around the perimeter of the central hole. This condition tested the effectiveness of the present technique for use in jointed and fractured rock.

*Reg. TM

EXAMPLE II

In a field example, the method of the invention was employed to produce a smooth wall crack in a limestone quarry. The limestone was extensively jointed, with jointing in the horizontal plane and one set of joints nearly perpendicular to the ultimate pit wall being the most prominent. A series of triad groups of boreholes, as shown in FIG. 3, were drilled vertically downward to a depth of three meters into the rock body and in alignment along a desired line of crack. The axes of the triad groups were aligned parallel to the pit wall. In each triad group, the larger central borehole was 25 cm in diameter and each smaller satellite borehole was 7.5 cm in diameter. The satellite boreholes were spaced 50 cm from the central borehole and the triad groups were spaced 4 meters apart. All distances are measured from centre to centre. The central boreholes were charged to their full depth with 32 mm diameter cartridged, gelatinized nitroglycerine explosives, which cartridges were separated from the borehole wall by suitable spacers. The charged boreholes were detonated by means of the same short period delay detonator to produce a strictly aligned fracture in the rock along the direction of the satellite holes. The resulting fracture was found to be aligned as well as continuous between two triad groups.

The smooth wall blasting method of the invention provides important improvements over earlier, known smooth wall blasting methods. The use of small diameter, closely spaced satellite boreholes aligned on two sides of a central charged borehole produces a stress-enhancing effect by which the energy from the detonating explosive is directed in a chosen plane to achieve a straight crack and a consequent smooth rock wall. Additionally, the method achieves a reduction in drilling cost by the use of smaller diameter drills. Compared to pre-splitting or pre-shear blasts, the invention requires a greatly reduced number of these small diameter holes. A reduction in explosive usage is also achieved. The resulting backwall, because of its relatively undamaged state, improves stability against pit-slope failures. This would allow steeper slopes resulting in a significant cost saving to open pit mining operations. The same effect would result in an increased stability of pillars and other structures in underground mining operations employing large diameter boreholes. The method of the invention is particularly well suited to large diameter mining and quarrying operations. These operations usually have on hand the required small diameter (5–7 cm) drills in addition to their large production drills. This smooth wall blasting technique imposes no special schedule of drilling as may be required by the currently used methods. The same production hole drilling pattern and diameter are maintained for the wall control blast. Drilling of the two small diameter holes beside each large diameter hole can be carried out without disrupting regular schedules at the mine or quarry site. Best results are achieved when these wall control holes are blasted with the same delay period, and prior to initiation of the rest of the production blast holes in front of it.

I claim:

1. An improved method of smooth wall blasting with explosives in rock comprising the steps of:

(a) drilling a group of aligned, triad boreholes in a rock body, the said triad group comprising a larger central borehole for explosive charging and one, empty, smaller, close-spaced, parallel satellite borehole on each side of the said central borehole;

(b) drilling a series of said group of triad boreholes at intervals along a line of desired crack or fracture in said rock;

(c) charging the said larger central borehole in each of said triad groups with explosives; and (d) detonating the said charged boreholes to produce a flat plane crack or fracture intersecting each of the said triad groups and in alignment therewith.

2. A method as claimed in claim 1 wherein the diameter of the said satellite boreholes are from $\frac{1}{2}$ to 1/6 the diameter of the said central borehole.

3. A method as claimed in claim 1 wherein the distance between the said triad of boreholes is equivalent to between 10 diameters and 25 diameters of the said central borehole.

4. A method as claimed in claim 1 wherein the said explosive charge comprises a continuous column of explosives.

5. A method as claimed in claim 1 wherein the said explosive charge comprises a series of separated charges.

6. A method as claimed in claim 5 wherein the said separated charges are detonated substantially simultaneously.

* * * * *